US005601219A

United States Patent [19]

Chen

[11] Patent Number: 5,601,219

[45] Date of Patent: Feb. 11, 1997

[54] CLOTHES HANGER COVERED WITH A TOY DOLL

[76] Inventor: Chao Y. Chen, 8F-3, No. 321, Fu Hsing S. Road, Sec. 1, Taipei, Taiwan

[21] Appl. No.: 645,275

[22] Filed: May 13, 1996

[51] Int. Cl.[6] ..... A47G 25/32; A47G 25/14

[52] U.S. Cl. ..... 223/85; 223/94

[58] Field of Search ..... 223/85, 92, 89; 446/73, 330; 403/321, 325

[56] References Cited

U.S. PATENT DOCUMENTS

| | | | |
|---|---|---|---|
| D. 123,389 | 11/1940 | Dunlap | D6/315 |
| 2,804,048 | 8/1957 | Sams | 403/321 |
| 3,345,711 | 10/1967 | McCarthy | 403/321 |
| 4,563,373 | 1/1986 | Barnett | 223/85 |
| 5,201,443 | 4/1993 | Oswald | 223/85 |
| 5,364,201 | 11/1994 | LaBarre | 403/221 |
| 5,503,311 | 4/1996 | Chen | 223/85 |

*Primary Examiner*—Bibhu Mohanty
*Attorney, Agent, or Firm*—Fish & Richardson P.C.

[57] ABSTRACT

A clothes hanger which includes a sleeve having two vertically spaced coupling slots, a toy doll covered around the sleeve and having a through hole, a hanging bar coupled to the bottom end of the sleeve, a sliding shaft supported on a spring inside the sleeve and moved in and out of the through hole of the toy doll, an end cap fastened to the top end of the sleeve to hold down the periphery of the through hole of the toy doll, a swivel hook coupled to the top end of the shaft and moved with the shaft in and out of a pocket at the top of the toy doll, the shaft having a springy strip with a raised coupling portion adapted for engaging one of the coupling slots to hold the hook in or out of the pocket of the toy doll.

7 Claims, 5 Drawing Sheets

CLOTHES HANGER COVERED WITH A TOY DOLL

BACKGROUND OF THE INVENTION

The present invention relates to clothes hangers, and relates more particularly to a rotary clothes hanger covered with a toy doll.

A variety of devices have been developed for hanging clothes, stockings, shoes, etc. "GARMENT HANGER AND TOY COMBINATION" of U.S. Pat. No. 5,201,443 discloses a garment hanger decorated with a toy doll. The hook of this structure of garment hanger is retractable. However, this structure of garment hanger is complicated. Furthermore, the stuffing of the toy doll tends to be forced to tangle with the actuating elements of the garment hanger. Therefore, this structure of garment hanger is not durable in use.

SUMMARY OF THE INVENTION

According to one aspect of the present invention, the clothes hanger comprises a sleeve having a first end, a second end, and a sleeve body connected the first end and second end of the sleeve, the sleeve body having a longitudinal sliding groove on the inside, a first coupling slot near the first end, and a second coupling slot near the second end; a spring mounted inside the sleeve; a shaft having a first end, a second end, and a shaft body connected between the first end and second end of the shaft, the second end of the shaft being inserted into the first end of the sleeve and stopped above the spring, the shaft body comprising a longitudinal sliding rib moved in the longitudinal sliding groove of the sleeve, and a longitudinal springy strip raised from a hole thereof, the longitudinal springy strip having a raised coupling portion adapted for engaging one of the first and second coupling slots of the sleeve; a hook coupled to the first end of the shaft; a toy doll covered around the sleeve, the toy doll having a covering face and a through hole in the covering face corresponding to the first end of the sleeve; a ring cap fastened to the first end of the sleeve and the through hole of the covering face of the toy doll to hold down the cover face of the toy doll; and a hanging bar coupled to the second end of the sleeve. According to another aspect of the present invention, a cover plate is fastened to the sleeve and covered over the first coupling slot and second coupling slot of the sleeve. According to still another aspect of the present invention, the cover plate has a hole coupled with a pressure bar, the pressure bar having one end fixedly secured to the covering face of the toy doll and being moved to deform the springy strip, causing it to disengage the raised coupling portion from the shaft. According to still another aspect of the present invention, the toy doll comprises a pocket adapted for receiving the hook. According to still another aspect of the present invention, a spring is connected between the sleeve and the pressure bar to impart an outward pressure to the pressure bar. As an alternate form of the present invention, the aforesaid pressure bar is eliminated, and the sleeve has an inside flange disposed at an elevation between the second coupling slot and the second end of the sleeve. The inside flange forces the springy strip inwards when the hook is forced to push the shaft downwards into the inside of the sleeve, thereby causing the raised coupling portion of the springy strip to disengage from the second coupling slot.

DETAILED DESCRIPTION OF THE PREFERRED EMBODIMENT

Figure 1:
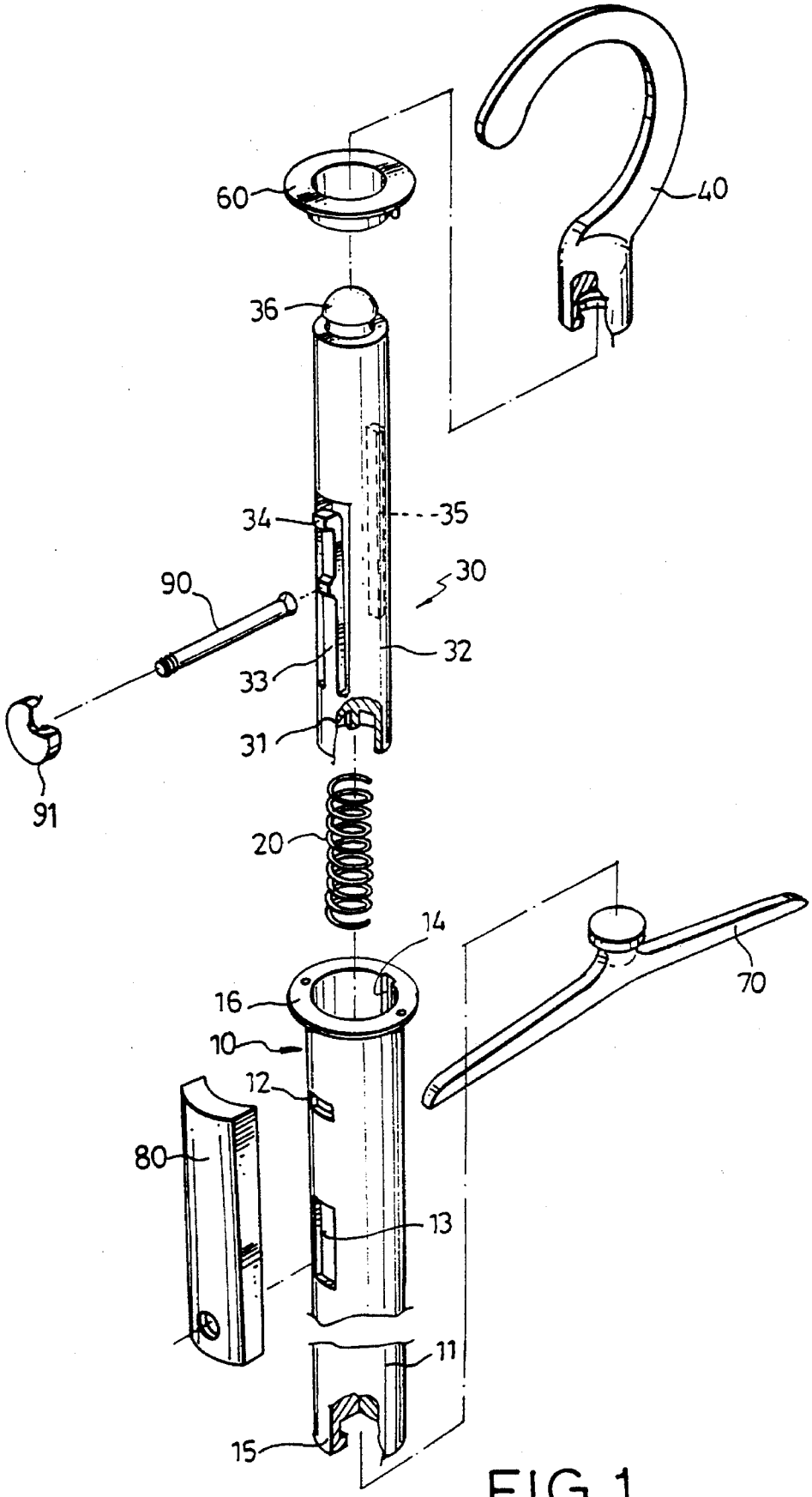
FIG. 1 is an exploded view of a clothes hanger according to the present invention (toy doll removed)

Referring to FIG. 1, the present invention comprises a sleeve 10, a spring 20, a shaft 30, a swivel hook 40, a toy doll 50 (see FIG. 2), a ring cap 60, and a hanging bar 70.

Figure 2:
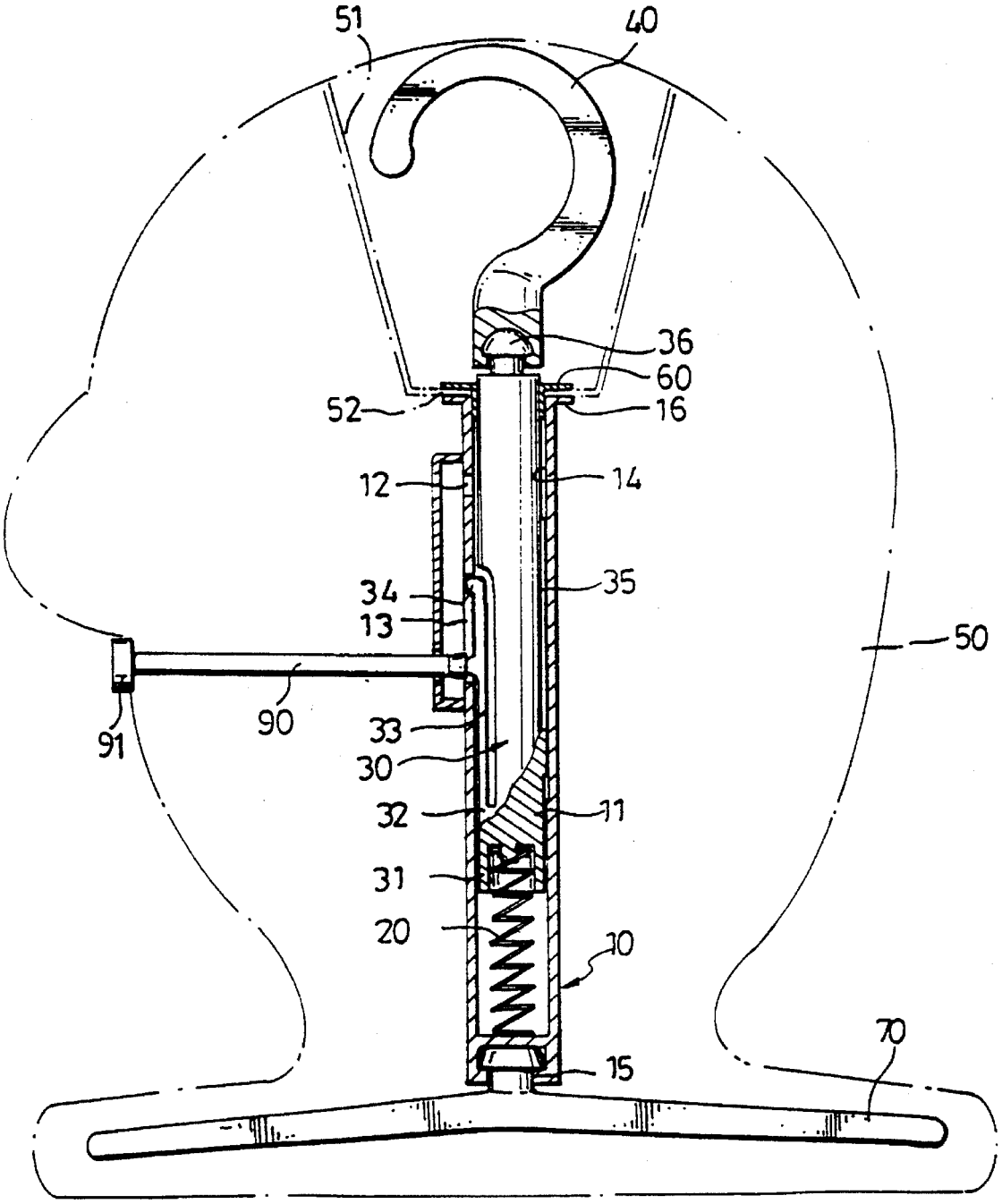
FIG. 2 is a sectional view of the present invention, showing the hook of the clothes hanger received inside the pocket of the toy doll.
Figure 3:
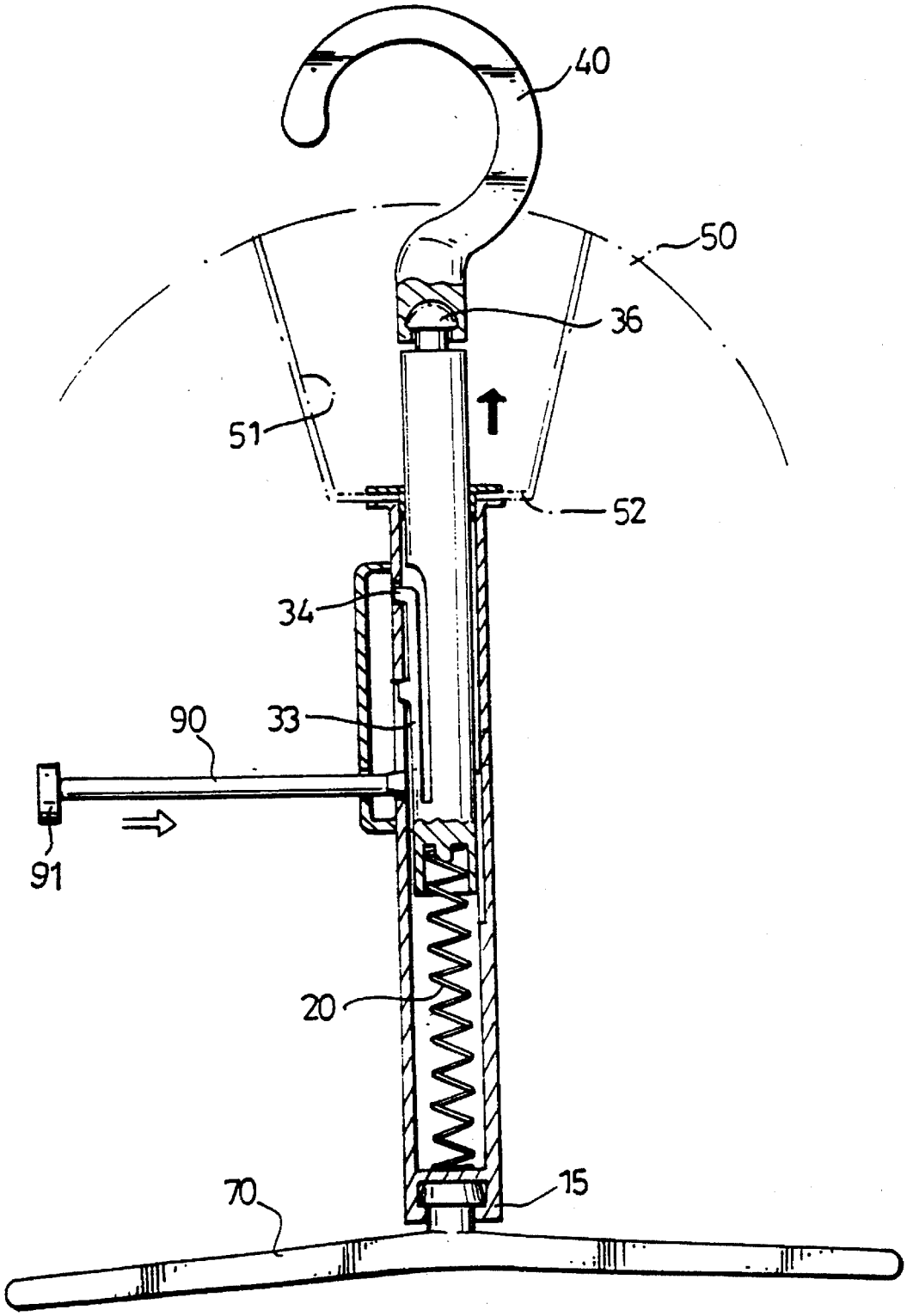
FIG. 3 is similar to FIG. 2 but showing the hook of the clothes hanger extended out of the pocket of the toy doll.

Referring to FIGS. 2 and 3, and FIG. 1 again, the spring 20 is mounted inside the sleeve 10. The bottom end 31 of the shaft 30 is inserted into the sleeve 10 and stopped above the spring 20. The shaft 30 has a longitudinal springy strip 33 made from the shaft body 32 thereof. The springy strip 33 has a raised coupling portion 34 adapted for coupling to the first coupling slot 12 or second coupling slot 13 in the sleeve,body 11 of the sleeve 10. The shaft 30 has a longitudinal sliding rib 35 raised from the outside wall of the shaft body 32 and adapted for engaging the longitudinal sliding groove 14 on the inside wall of the sleeve body 11 of the sleeve 10. The swivel hook 40 is coupled to the top end 36 of the shaft 30. The hanging bar 70 is coupled to the bottom end 15 of the sleeve 10. The toy doll 50 is covered around the shaft 10 and the hanging bar 70, having a pocket 51 at the top adapted for receiving the swivel hook 40 (see FIG. 2). The ring cap 60 is mounted around the top end 16 of the sleeve 10 to clamp the covering face 52 of the toy doll 5, permitting it to be firmly retained in between the ring cap 60 and the top end 16 of the sleeve 10. A cover plate 80 is secured to the sleeve 10 and covered over the first coupling slot 12 and the second coupling slot 13 to stop the stuffing of the toy doll 50 from projecting into the sleeve 10.

Referring to FIGS. 2 and 3 again, when the swivel hook 40 is forced down and received in the pocket 51 of the toy doll 50, the raised coupling portion 34 of the springy strip 33 of the shaft 30 is forced into the second coupling slot 13 of the sleeve 10. A pressure bar 90 is mounted inside the toy doll 50 and moved in a hole (not shown) in the cover plate 80, having a head 91 at one end fixedly secured to the outside wall of the covering face 52. The pressure bar 90 and the sleeve 10 are arranged at right angles. When the head 91 of the pressure bar 90 is pushed inwards, the raised coupling portion 34 of the springy strip 33 of the shaft 30 is forced out of the second coupling slot 13 by the pressure bar 90, thereby causing the shaft 30 to be pushed out of the pocket 51 of the toy doll 50 by the spring 20. When the shaft 30 is pushed out of the pocket 51 of the toy doll 50, the raised coupling portion 34 of the springy strip 33 of the shaft 30 is forced into engagement with the first coupling slot 12 to hold the shaft 30 is position, and at the same time the toy doll 50 returns to its former shape (because the stuffing of the toy doll is made from bulky material) to force the pressure bar 90 back to its former position.

Figure 4:
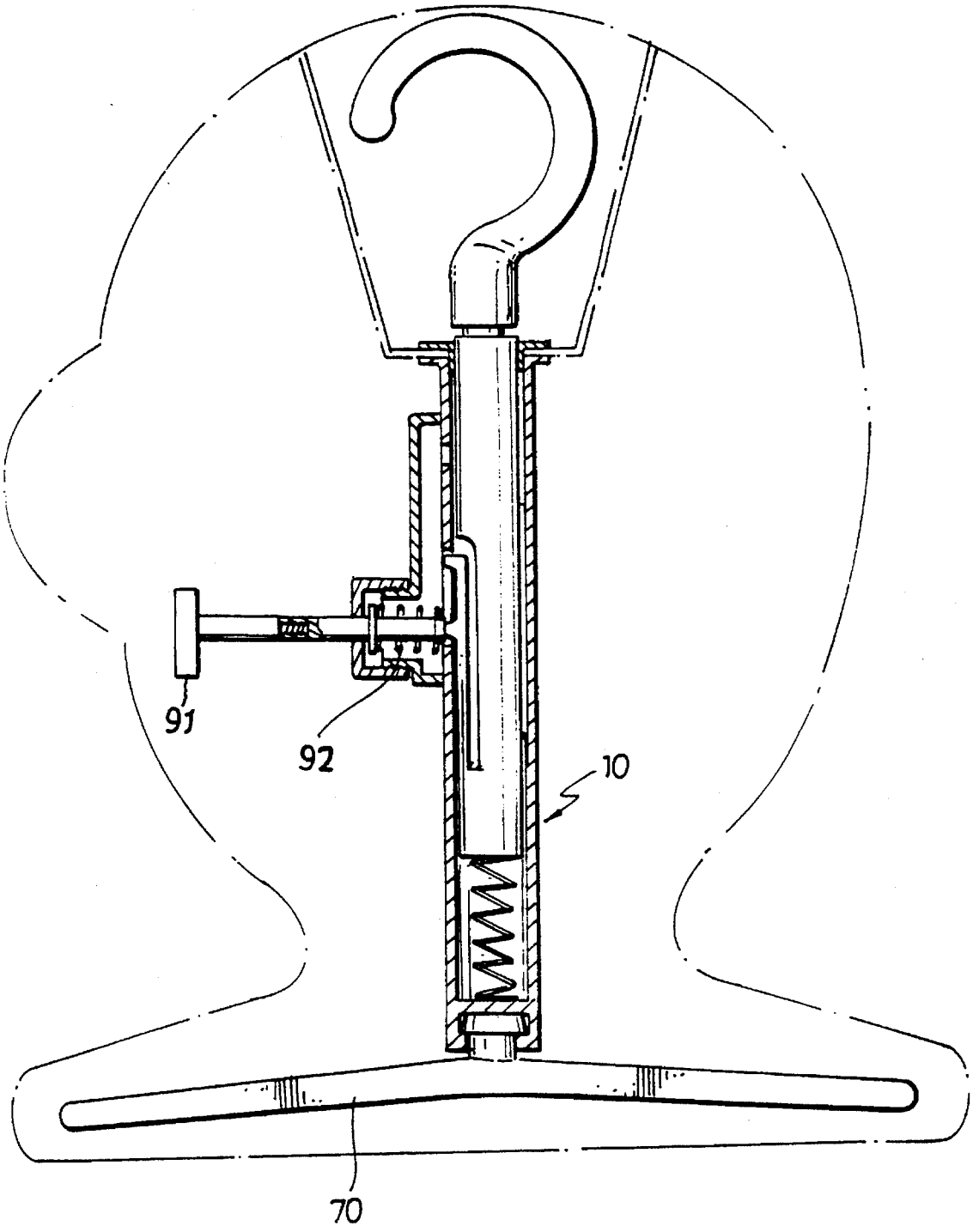
FIG. 4 is similar to FIG. 2 but showing a spring connected between the sleeve and the pressure bar.

Referring to FIG. 4, a spring 93 may be mounted on the sleeve 10 to impart an outward pressure to the pressure bar 90 so that the pressure bar 90 can be quick forced back to its former position by the spring 93 after each operation.

Figure 5:
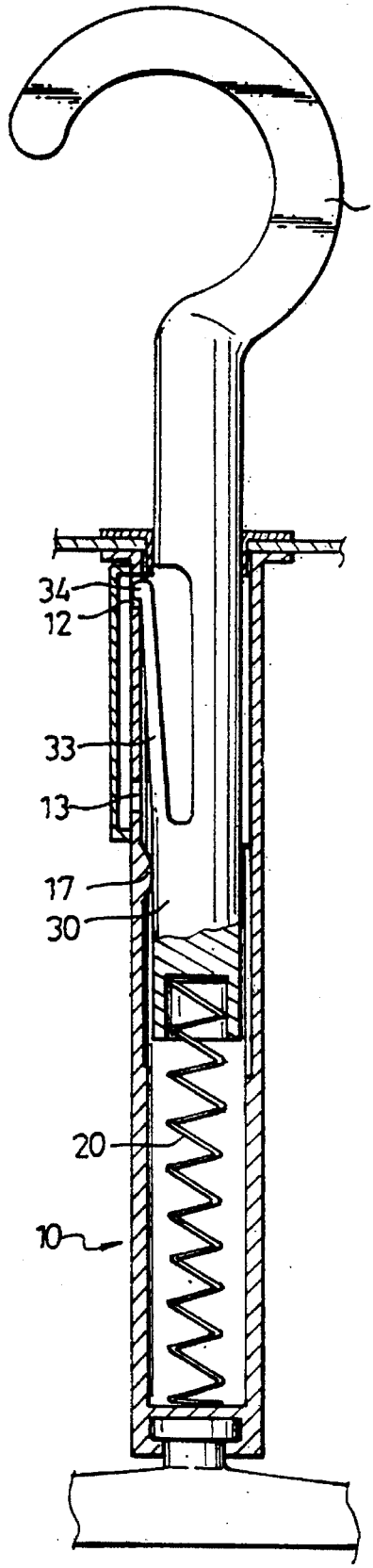
FIG. 5 is a sectional view of an alternate form of the present invention, showing the shaft extended out of the sleeve and the raised coupling portion engaged with the first coupling slot of the sleeve.
Figure 6:
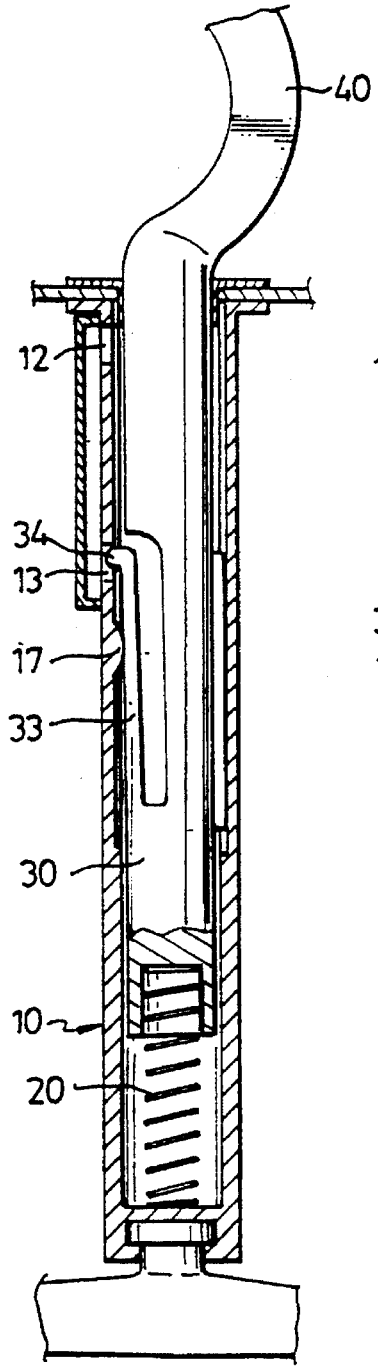
FIG. 6 is another sectional view of the alternate form of the present invention, showing the raised coupling portion of the springy strip engaged with the second coupling slot of the sleeve.
Figure 7:
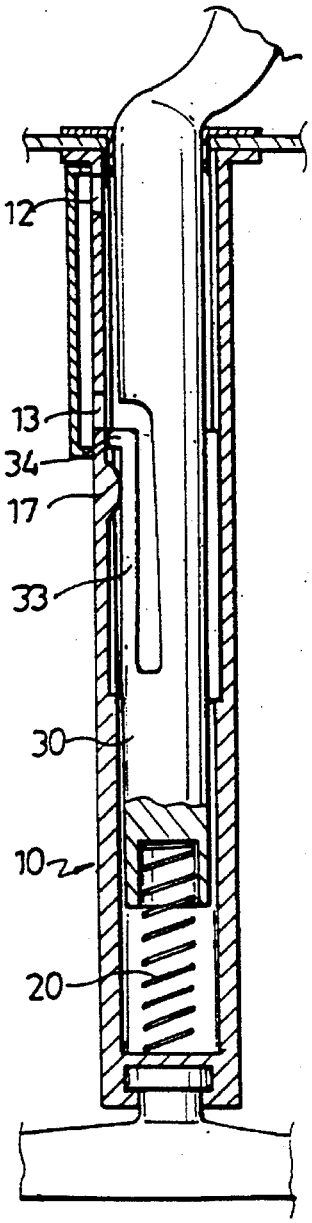
FIG. 7 is still another sectional view of the alternate form of the present invention, showing the springy strip forced inwards, and the raised coupling portion of the springy strip disengaged from the second coupling slot of the sleeve.

FIGS. 5, 6, and 7 show an alternate form of the present invention. When the swivel hook 40 is extended out (see FIG. 5), the raised coupling portion 34 of the springy strip 33 of the shaft 30 is forced into engagement with the first coupling slot 12 of the sleeve 10; when the swivel hook 30 is received (see FIG. 6), the raised coupling portion 34 of the springy strip 33 of the shaft 30 is forced into the second coupling 13 of the sleeve 10; when the swivel hook 40 is pressed down again (see FIG. 7), the springy strip 33 of the shaft 30 is forced inwards by the inside flange 17 of the sleeve 10 to disengage the raised coupling portion 34 from the second coupling slot 13, permitting the shaft 30 to be quickly forced upwards by the spring 20.

It is to be understood that the drawings are designed for purposes of illustration only, and are not intended as a definition of the limits and scope of the invention disclosed.

What the invention claimed is:

1. A clothes hanger comprising:

a sleeve having a first end, a second end, and a sleeve body connected to the first end and second end of said sleeve, said sleeve body having a longitudinal sliding groove on the inside, a first coupling slot near said first end, and a second coupling slot near said second end;

a spring mounted inside said sleeve;

a shaft having a first end, a second end, and a shaft body connected between the first end and second end of said shaft, the second end of said shaft being inserted into the first end of said sleeve and stopped above said spring, said shaft body comprising a longitudinal sliding rib moved in the longitudinal sliding groove of said sleeve, and a longitudinal springy strip raised from a hole thereof, said longitudinal springy strip having a raised coupling portion adapted for engaging one of the first and second coupling slots of said sleeve;

a hook coupled to the first end of said shaft;

a toy doll covered around said sleeve, said toy doll having a covering face and a through hole in said covering face corresponding to the first end of said sleeve;

a ring cap fastened to the first end of said sleeve and the through hole of the covering face of said toy doll to hold down the cover face of said toy doll; and a hanging bar coupled to the second end of said sleeve.

2. The clothes hanger of claim 1 further comprising a cover plate fastened to said sleeve and covered over the first coupling slot and second coupling slot of said sleeve.

3. The clothes hanger of claim 2 wherein said cover plate has a hole coupled with a pressure bar, said pressure bar having one end fixedly secured to the covering face of said toy doll and being moved to deform said springy strip, causing it to disengage said raised coupling portion from said shaft.

4. The clothes hanger of claim 2 wherein said hook and said shaft are integrally connected together.

5. The clothes hanger of claim 2 wherein said toy doll comprises a pocket adapted for receiving said hook.

6. The clothes hanger of claim 3 wherein a spring is connected between said sleeve and said pressure bar to impart an outward pressure to said pressure bar.

7. The clothes hanger of claim 1 wherein said sleeve has an inside flange disposed at an elevation between said second coupling slot and the second end of said sleeve, said inside flange forcing said springy strip inwards when said hook is forced to push said shaft downwards into the inside of said sleeve, thereby causing the raised coupling portion of said springy strip to disengage from the second coupling slot of said sleeve.

* * * * *